US006092788A

United States Patent [19]

Simon

[11] Patent Number: 6,092,788

[45] Date of Patent: Jul. 25, 2000

[54] VEHICULAR PNEUMATIC JACK

[76] Inventor: Deborah Simon, 20 Dhly Ct., Ridgefield, Conn. 06877

[21] Appl. No.: 09/160,164

[22] Filed: Sep. 25, 1998

[51] Int. Cl.[7] ..... B66F 3/24

[52] U.S. Cl. ..... 254/93 HP; 254/122

[58] Field of Search ..... 254/93 HP, 122, 254/8 C, 9 C; 187/211; 182/63, 69, 14, 16, 141, 157; 92/34–42

[56] References Cited

U.S. PATENT DOCUMENTS 2,610,824 9/1952 Grier ..... 254/93 HP 3,891,108 6/1975 Traficant ..... 254/122

5,938,179 8/1999 Beukers et al. ..... 254/93 HP

*Primary Examiner*—Robert C. Watson

[57] ABSTRACT

A pneumatic jack is provided including a frame having a rigid top member, a rigid bottom member, and an elevation assembly coupled therebetween for maintaining the top member above the bottom member. Also included is an inflatable chamber situated between the top member and the bottom member of the frame with a valve for receiving air to selectively elevate the top member of the frame with respect to the bottom member.

11 Claims, 2 Drawing Sheets

VEHICULAR PNEUMATIC JACK

BACKGROUND OF THE INVENTION

1. Field of the Invention

The present invention relates to jacks and more particularly pertains to a new vehicular pneumatic jack for lifting a vehicle by way of an inflatable chamber so maintenance may be performed on the vehicle.

2. Description of the Prior Art

The use of jacks is known in the prior art. More specifically, jacks heretofore devised and utilized are known to consist basically of familiar, expected and obvious structural configurations, notwithstanding the myriad of designs encompassed by the crowded prior art which have been developed for the fulfillment of countless objectives and requirements.

Known prior art jacks and the like include U.S. Pat. No. 4,372,533; U.S. Pat. No. 4,067,544; U.S. Pat. No. Des. 301,669; U.S. Pat. No. 4,605,203; U.S. Pat. No. 5,441,237; and U.S. Pat. No. 5,085,405.

In these respects, the vehicular pneumatic jack according to the present invention substantially departs from the conventional concepts and designs of the prior art, and in so doing provides an apparatus primarily developed for the purpose of lifting a vehicle by way of an inflatable chamber so maintenance may be performed on the vehicle.

SUMMARY OF THE INVENTION

In view of the foregoing disadvantages inherent in the known types of jacks now present in the prior art, the present invention provides a new vehicular pneumatic jack construction wherein the same can be utilized for lifting a vehicle by way of an inflatable chamber so maintenance may be performed on the vehicle.

The general purpose of the present invention, which will be described subsequently in greater detail, is to provide a new vehicular pneumatic jack apparatus and method which has many of the advantages of the jacks mentioned heretofore and many novel features that result in a new vehicular pneumatic jack which is not anticipated, rendered obvious, suggested, or even implied by any of the prior art jacks, either alone or in any combination thereof.

To attain this, the present invention generally comprises a frame having a rigid planar top plate and a rigid planar bottom plate. Each plate is equipped with a periphery having a equilateral triangular configuration. As shown in FIGS. 1 & 2, each side edge of both plates have an elevation assembly mounted adjacent to each end thereof. Each elevation assembly of the frame includes a plurality of cross members being pivotally coupled at centers thereof to define a plurality of cross member pairs. As shown in FIGS. 3 & 4, ends of the cross members of each cross member pair is pivotally coupled to ends of the cross members of an adjacent cross member pair. A bottommost and a topmost cross member pair of each elevation assembly is pivotally mounted to the end of the corresponding edge of the bottom plate and the top plate, respectively. With particular reference to FIGS. 3 & 4, it is shown that the central extent of one of the cross member pairs includes two pair of opposed semicircular recesses. During use, the aforementioned recesses are adapted for maintaining a height of the associated elevation assembly upon the insertion of a pin therebetween. Finally, an inflatable chamber is situated between the top plate and the bottom plate of the frame. The chamber has three side faces each having a top edge and a bottom edge coupled to one of the edges of the top plate and the bottom plate of the frame, respectively. As shown in FIGS. 1 & 2, one of the side faces has a valve mounted on a central extent thereof. Such valve serves for receiving air to elevate the top plate of the frame with respect to the bottom plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vehicular pneumatic jack apparatus and method which has many of the advantages of the jacks mentioned heretofore and many novel features that result in a new vehicular pneumatic jack which is not anticipated, rendered obvious, suggested, or even implied by any of the prior art jacks, either alone or in any combination thereof.

It is another object of the present invention to provide a new vehicular pneumatic jack which may be easily and efficiently manufactured and marketed.

It is a further object of the present invention to provide a new vehicular pneumatic jack which is of a durable and reliable construction.

An even further object of the present invention is to provide a new vehicular pneumatic jack which is susceptible of a low cost of manufacture with regard to both materials and labor, and which accordingly is then susceptible of low prices of sale to the consuming public, thereby making such vehicular pneumatic jack economically available to the buying public.

Still yet another object of the present invention is to provide a new vehicular pneumatic jack which provides in the apparatuses and methods of the prior art some of the advantages thereof, while simultaneously overcoming some of the disadvantages normally associated therewith.

Still another object of the present invention is to provide a new vehicular pneumatic jack for lifting a vehicle by way of an inflatable chamber so maintenance may be performed on the vehicle.

Even still another object of the present invention is to provide a new vehicular pneumatic jack that includes a frame having a rigid top member, a rigid bottom member, and an elevation assembly coupled therebetween for maintaining the top member above the bottom member. Also included is an inflatable chamber situated between the top member and the bottom member of the frame with a valve for receiving air to selectively elevate the top member of the frame with respect to the bottom member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
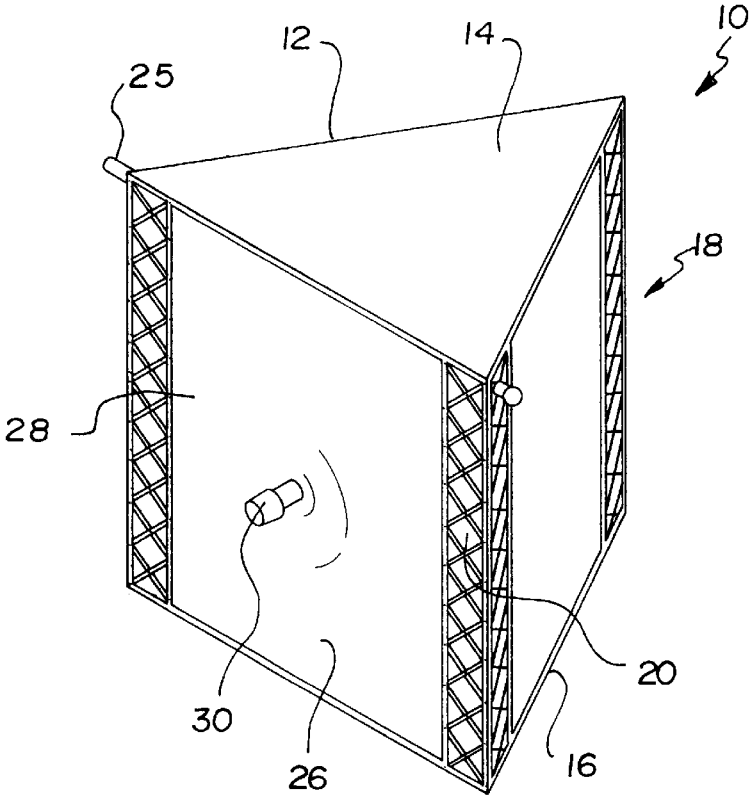
FIG. 1 is a perspective view of a new vehicular pneumatic jack according to the present invention.

With reference now to the drawings, and in particular to FIGS. 1 through 4 thereof, a new vehicular pneumatic jack embodying the principles and concepts of the present invention and generally designated by the reference numeral 10 will be described.

Figure 2:
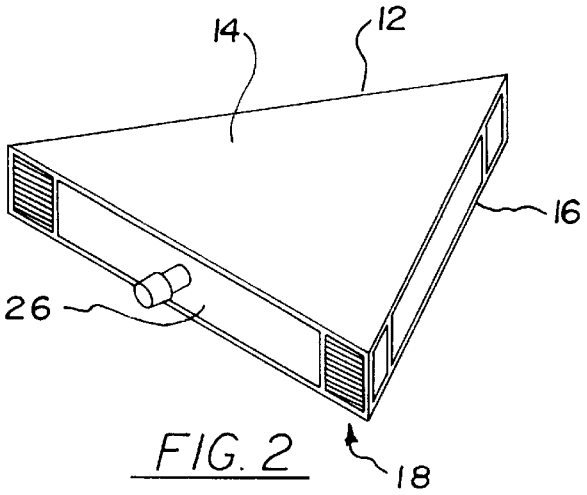
FIG. 2 is a perspective view of the present invention in a deflated, lowered orientation.

The present invention, designated as numeral 10, includes a frame 12 having a rigid planar top plate 14 and a rigid planar bottom plate 16. Each plate is equipped with a periphery having a equilateral triangular configuration. In the preferred embodiment, each side edge of the plates is about 14 inches in length. As shown in FIGS. 1 & 2, each side edge of both plates has a steel elevation assembly 18 mounted adjacent to each end thereof.

Figure 3:
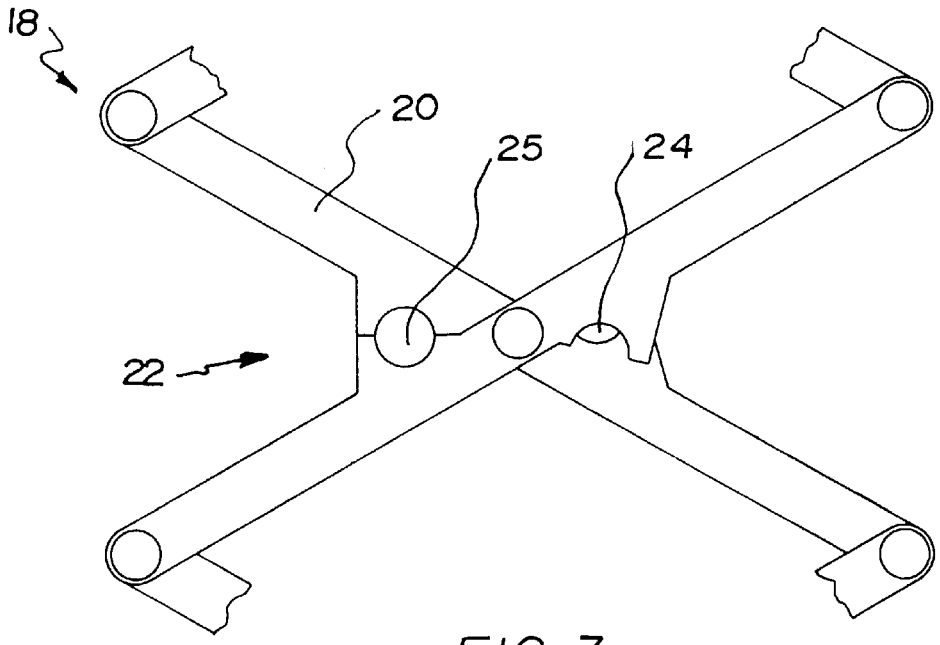
FIG. 3 is a side view of one of the cross member pairs of the present invention in a partially extended orientation.
Figure 4:
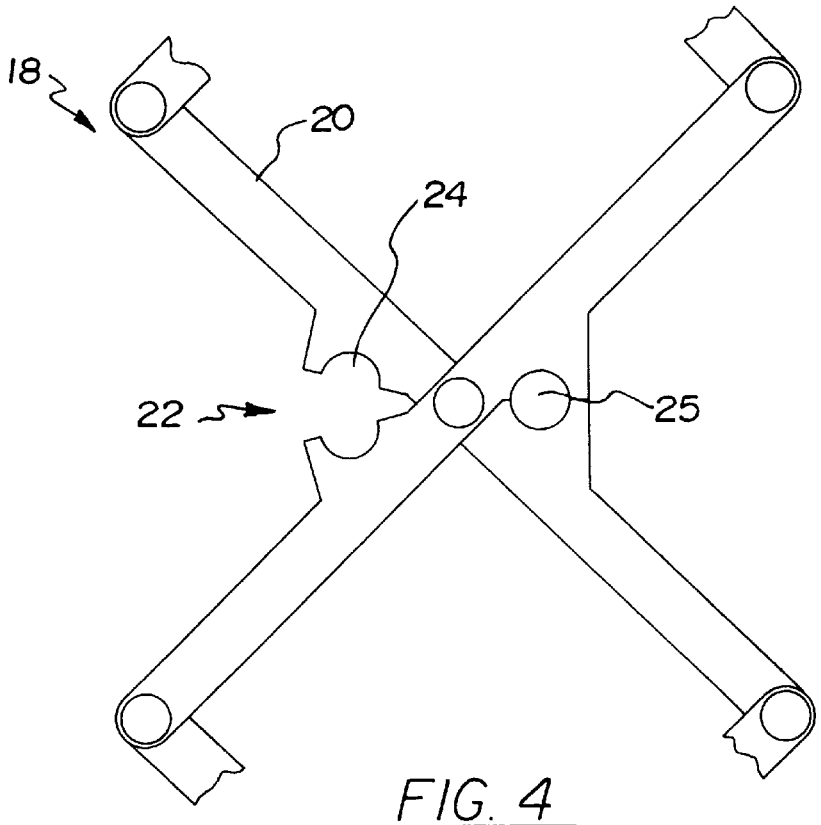
FIG. 4 is a side view of one of the cross member pairs of the present invention in a fully extended orientation.

Each elevation assembly of the frame includes a plurality of cross members 20 being pivotally coupled at centers thereof to define a plurality of cross member pairs 22. As shown in FIGS. 3 & 4, ends of the cross members of each cross member pair is pivotally coupled to ends of the cross members of an adjacent cross member pair. The cross members of a bottommost and a topmost cross member pair of each elevation assembly have a length which is half that of the remaining cross members. The ends of the cross members of the bottommost and the topmost cross member pair are pivotally coupled to each other at an end of the corresponding edge of the bottom plate and the top plate, respectively.

With particular reference to FIGS. 3 & 4, it is shown that the central extent of the cross members of one of the cross member pairs includes two pair of opposed semicircular recesses 24. Ideally, the recesses of a first pair extends from the associated cross member a first distance while a second pair of the recesses each extend from the associated cross member a second distance greater than the first distance.

During use, the aforementioned recesses are adapted for maintaining a height of the associated elevation assembly upon the insertion of a pin 25 therebetween. Depending on which pair of recesses receive the pin, the corresponding elevation assembly may be elevated a height ½ that which the elevation assembly is capable or a height that requires the cross members of the elevation assembly to be fully extended.

Finally, an inflatable vinyl chamber 26 is situated between the top plate and the bottom plate of the frame. The chamber has three side faces 28 each having a top edge and a bottom edge adhesively coupled to one of the edges of the top plate and the bottom plate of the frame, respectively. As shown in FIGS. 1 & 2, one of the side faces has a valve 30 mounted on a central extent thereof. Such valve serves for receiving air to elevate the top plate of the frame with respect to the bottom plate. When elevated, the locking pin may be positioned in place to safely fix the height of the frame.

In use, the bottom plate may be positioned on a recipient surface while the top plate is situated beneath a vehicle. Thereafter, the present invention may be used to elevate the vehicle for the purpose of performing maintenance such as changing a tire. While not shown, the present invention preferably includes a can of compressed air for being connected to the valve of the inflatable chamber and inflating the same. Further, an air compressor may be provided which may be powered by a cigarette lighter socket of the vehicle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pneumatic jack comprising, in combination:

a frame including a rigid planar top plate and a rigid planar bottom plate each having a periphery with a equilateral triangular configuration, each side edge of the peripheries of the plates having an elevation assembly mounted adjacent to each end thereof with each elevation assembly including a plurality of cross members being pivotally coupled at centers thereof to define a plurality of cross member pairs, ends of the cross members of each cross member pair being pivotally coupled to ends of the cross members of an adjacent cross member pair, wherein a bottommost and a topmost one of the cross member pairs of each elevation assembly is pivotally mounted to the end of the corresponding edge of the bottom plate and the top plate, respectively, wherein the central extent of the cross members of one of the cross member pairs includes two pair of opposed semicircular recesses for maintaining a height of the associated elevation assembly upon the insertion of a pin therebetween; and an inflatable chamber situated between the top plate and the bottom plate of the frame with three side faces each having a top edge and a bottom edge coupled to one of the edges of the top plate and the bottom plate of the frame, respectively, one of the side faces having a valve mounted on a central extent thereof for receiving air to elevate the top plate of the frame with respect to the bottom plate.

2. A pneumatic jack comprising:

a frame including a rigid top member, a rigid bottom member, and an elevation assembly coupled therebetween for maintaining the top member above the bottom member; and an inflatable chamber situated between the top member and the bottom member of the frame with a valve for receiving air to elevate the top member of the frame with respect to the bottom member; and wherein a plurality of elevation assemblies are provided at spaced locations about said inflatable chamber to resist tipping of the top member with respect to the bottom member, each elevation assembly including a plurality of cross members, pairs of the cross members being pivotally coupled to define a plurality of cross member pairs, ends of the cross members of each cross member pair being pivotally coupled to ends of the cross members of an adjacent cross member pair; and;

wherein the center of the cross members of one of the cross member pairs includes two pair of opposed semicircular recesses for maintaining a height of the associated elevation assembly upon the insertion of a pin therebetween.

3. A pneumatic jack as set forth in claim 2 wherein each member includes a planar plate with a triangular configuration.

4. A pneumatic jack as set forth in claim 2 wherein the cross member pairs of the elevation assembly are capable of being locked to fix a height of the top member with respect to the bottom member.

5. A pneumatic jack as set forth in claim 2 wherein the plurality of elevation assemblies comprises three elevation assemblies.

6. A pneumatic jack as set forth in claim 5 wherein each of the three elevation assemblies are located at vertices of the triangle.

7. A pneumatic jack comprising:

a frame including a rigid top member, a rigid bottom member, and an elevation assembly coupled therebetween for maintaining the top member above the bottom member; and an inflatable chamber situated between the top member and the bottom member of the frame with a valve for receiving air to elevate the top member of the frame with respect to the bottom member; and wherein a plurality of elevation assemblies are provided at spaced locations about said inflatable chamber to resist tipping of the top member with respect to the bottom member, each elevation assembly including a plurality of cross members, pairs of the cross members being pivotally coupled to define a plurality of cross member pairs, ends of the cross members of each cross member pair being pivotally coupled to ends of the cross members of an adjacent cross member pair; and wherein the plurality of elevation assemblies comprises three elevation assemblies.

8. A pneumatic jack as set forth in claim 7 wherein each member includes a planar plate with a triangular configuration.

9. A pneumatic jack as set forth in claim 7 wherein the center of the cross members of one of the cross member pairs includes two pair of opposed semicircular recesses for maintaining a height of the associated elevation assembly upon the insertion of a pin therebetween.

10. A pneumatic jack as set forth in claim 7 wherein the cross member pairs of the elevation assembly are capable of being locked to fix a height of the top member with respect to the bottom member.

11. A pneumatic jack as set forth in claim 7 wherein each of the three elevation assemblies are located at vertices of the triangle.

* * * * *